US009469513B2

(12) United States Patent
Rogers, II et al.

(10) Patent No.: US 9,469,513 B2
(45) Date of Patent: Oct. 18, 2016

(54) RATCHETING, SELF-ALIGNING LOAD-SUPPORT DEVICE

(71) Applicants: James O Rogers, II, Milford, OH (US); James O Rogers, III, Marysville, OH (US)

(72) Inventors: James O Rogers, II, Milford, OH (US); James O Rogers, III, Marysville, OH (US)

( * ) Notice: Subject to any disclaimer, the term of this patent is extended or adjusted under 35 U.S.C. 154(b) by 36 days.

(21) Appl. No.: 14/588,458

(22) Filed: Jan. 1, 2015

(65) Prior Publication Data

US 2016/0194185 A1 Jul. 7, 2016

Related U.S. Application Data

(60) Provisional application No. 61/923,711, filed on Jan. 5, 2014.

(51) Int. Cl.
*B66F 3/00* (2006.01)
*B66F 3/30* (2006.01)
*B66F 3/24* (2006.01)

(52) U.S. Cl.
CPC . *B66F 3/30* (2013.01); *B66F 3/00* (2013.01); *B66F 3/24* (2013.01)

(58) Field of Classification Search
USPC ..... 254/108
See application file for complete search history.

(56) References Cited

U.S. PATENT DOCUMENTS

| | | | | | |
|---|---|---|---|---|---|
| 172,925 | A * | 2/1876 | Joyce | B66F 1/06 | 254/112 |
| 1,201,413 | A * | 10/1916 | Willour | B66F 1/06 | 251/109 |
| 1,230,818 | A * | 6/1917 | Bates | B66F 1/06 | 254/111 |
| 1,503,343 | A * | 7/1924 | Armstrong | B66F 1/06 | 254/111 |
| 2,138,276 | A * | 11/1938 | Johnson | B66F 1/06 | 254/111 |
| 3,047,269 | A * | 7/1962 | Renshaw | B66F 3/30 | 254/133 R |
| 5,000,424 | A * | 3/1991 | Inoue | B66F 5/04 | 254/93 H |
| 5,009,394 | A * | 4/1991 | Marshall | E01F 9/623 | 254/30 |
| 6,902,148 | B1 * | 6/2005 | Spencer | B66F 3/30 | 254/2 B |
| 2015/0308612 | A1 * | 10/2015 | Chen | F16M 11/28 | 248/352 |

* cited by examiner

*Primary Examiner* — Alvin Grant
(74) *Attorney, Agent, or Firm* — Neal O. Willmann

(57) ABSTRACT

Disclosed herein is a ratcheting, self-aligning load-lifting device featuring a ram, responsive to a pressurized medium, having at least one rack of teeth and a keyway slot, and a ratchet mechanism encircling the ram. The ratchet mechanism has at least one pawl for engagement with the rack of teeth during elevation of the ram, a set screw extending into the keyway to maintain proper alignment of the mechanism, a spring plunger radially positioned for engagement with the keyway slot after the ratchet mechanism has been rotated and the pawl has been released from the elevated rack of teeth, and a biasing means positioned within and attached to rotate the ratchet mechanism thereby urging the re-engagement of the pawl with the lowered rack of teeth.

7 Claims, 10 Drawing Sheets

RATCHETING, SELF-ALIGNING LOAD-SUPPORT DEVICE

CROSS-REFERENCE TO A RELATED APPLICATION

This application claims the benefit of Provisional Patent Application Ser. No. 61/923,711 filed Jan. 5, 2014, which is hereby incorporated by reference.

FIELD OF THE INVENTION

This disclosure relates generally to a load support device and more particularly to a ratcheting, self-aligning load-support device with safety features to prevent the unintended collapse or failure of the device when it is in the load support mode.

BACKGROUND OF THE INVENTION

Hydraulic jacks are well-known mechanical devices and are generally used to raise and lower various types of loads, typically automobiles, off the ground. However, hydraulic fluid, the medium for raising and lowering the ram, may, over a period of time, leak past internal seals and allow the load or burden to unintentionally descend. In some instances, seal failure may cause the load to descend spontaneously without warning presenting an unacceptable risk to anyone in proximity to the jack and load.

When using a typical jack to facilitate an automobile repair, it is common practice to eliminate the risk of spontaneous jack (ram) collapse by placing one or more safety stands under the elevated load and then lowering and removing the jack. This practice is problematic and inconvenient, especially with unibody vehicles, which typically have only a limited number of reinforced areas suitable for lifting the vehicle and supporting its weight. Thus, if the operator has used a jack on one of the provided lift points, there is generally limited space for placing a safety stand adjacent to the jack, and the operator must be judicious in selecting an area for the safety stand that will support the vehicle's weight because improper positioning introduces the possibility of damage to the vehicle's frame, or even more serious damage may result from the improvidently positioned safety stand punching through the floorboard allowing the vehicle to suddenly fall to the ground with possible injury to the operator.

There is a need for a device that functions both as a jack and as a safety stand, and the disclosed ratcheting, self-aligning load-support device functions in that manner and meets that need. It eliminates the use of a separate jack and safety stand and thereby saves time, effort and avoids possible damage to the vehicle and injury to anyone in the event of jack failure and collapse. Efforts have been made in the past to address the need of a jack and safety stand combination. The following patent documents are representative of efforts made in that regard.

DESCRIPTION OF THE PRIOR ART

U.S. Pat. No. 5,000,424, which issued to Inoue on Mar. 19, 1991, discloses a jack having the means to lock an elevated piston (ram) in place by employing a threaded annular stopper, or ring, affixed to threads cut into the surface of the piston. After raising the load, the operator spins the ring repeatedly to move it upwards on the piston, thereby locking the piston in position at the desired height.

This approach is time and labor intensive and unacceptable. It requires the operator to spin the stopper repeatedly over a substantial distance once the load has been raised to the desired height, and then reverse the process by spinning the stopper back to the original position before being able to lower the load. Inoue discloses an alternate embodiment utilizing a rudimentary rack and pawl arrangement but fails to elaborate on how it could function safely in actual practice because the mechanism to release the pawl is exposed and subject to accidental disengagement.

U.S. Pat. No. 6,902,148, which issued to C. Spencer on Jun. 7, 2005, describes a jack having what is referred to as a "prop" extending parallel to an elevated piston extending out of a bottle jack housing and containing receptacles in which to place pins to restrict lowering the elevated piston. Requiring the placement of pins to insure the elevation of the extended piston is commendable but manipulating the pins discourages their use and complicates the use of the device.

U.S. Pat. No. 7,147,211, which issued to R. Porter on Dec. 12, 2006, describes an integrated jack and stand having a locking mechanism with pivoting teeth installed on a shaft that is pushed from below as the piston is raised. While rising, each tooth compresses into the shaft as needed to pass through a hole, but expanding outward again on the other side. The expanded teeth prevent the shaft from lowering back through the hole. Porter also discloses a mechanism designed to be selectively disengaged to open a passageway so that the jack can be lowered.

U.S. Pat. No. 8,333,365, which issued to Z. Dai on Dec. 18, 2012, describes a jack having a slit nut collar that can be selectively engaged against threads cut into the surface of the jack piston. The operator disengages the locking mechanism before raising the load and then engages the lock after the intended height has been reached. The locking mechanism employs a slit nut collar with a trapezoidal cross-section that compresses against the piston as it is lowered causing threads on the collar to engage with threads on the piston. This device requires the operator to disengage the safety mechanism prior to use and requires that it be manually reengaged after the load has been raised.

Unlike devices known in the prior art, the device described and claimed herein provides a jack having an automatic and reliable locking mechanism capable of supporting a heavy load indefinitely without requiring the operator to account for additional parts or manually engage a safety mechanism while raising or lowering the load.

SUMMARY OF THE INVENTION

The invention described herein is a jack with an integrated ratchet mechanism for raising, lowering and maintaining positive locking engagement with a pressurized ram capable of supporting a load even if the pressurized medium supporting the ram were to fail. The disclosed device features a conventional jack having a modified ram and a ratchet load-support mechanism which is unique in its design and function. The device functions as a jack while simultaneously supporting its load regardless of seal damage or failure. Furthermore, the device defaults to a locked load-support position. Manual intervention by the operator is required only to release the load-support mechanism before lowering the load. When lowered, the mechanism automatically resets back to the default position when the jack reaches a fully retracted (lowered) position.

Essentially and more specifically, the ratcheting, self-aligning load-support device described herein comprises a housing having a base for the stable placement of the device.

The housing contains a ram having a plurality of rack teeth along its length as well as a keyway slot, offset from the rack teeth, also extending a predetermined length along the ram. The housing also has an apical opening for the vertical extension of the ram. Additionally, the disclosed device has a reservoir for the containment of a medium in communication with the housing and a means attached to the reservoir for pressurizing the medium.

Attached to the apical opening in the housing are upper and lower ring assemblies, mated to allow rotation between the assemblies. Preferably, the lower ring assembly is threadably attached to the apical opening in the housing. Within the upper ring assembly is at least one pawl biased to engage with the rack teeth, and within the lower ring assembly is a set screw radially positioned for continuous engagement with the keyway slot to maintain the alignment of the teeth on the ram with the pawl on the upper ring assembly.

Also positioned within the upper ring assembly is a plunger for engagement with the keyway slot after the ring assemblies have been rotated to disengage the pawl from the rack teeth, thus permitting the lowering of the ram.

And finally, a biasing means is attached to and positioned between the upper and lower ring assemblies, biased to urge the upper ring assembly to rotate when the ram has been fully lowered, thereby re-engaging the pawl with the rack teeth.

DESCRIPTION OF THE PREFERRED EMBODIMENTS

Figure 1:
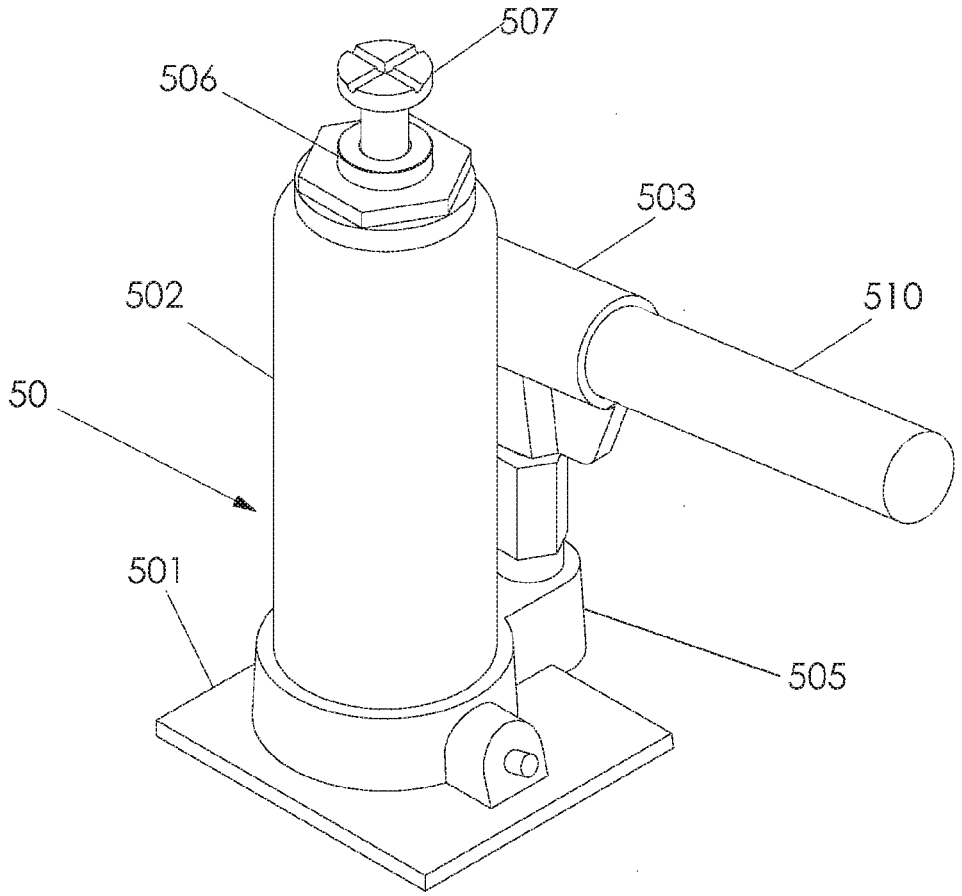
Fig. 1 PRIOR ART
FIG. 1 depicts a conventional bottle jack.

An appreciation of the disclosed ratcheting, self-aligning, load-support device described herein begins appropriately with the prior art. FIG. 1 depicts a conventional hydraulic bottle jack, which has many of the external features of the disclosed device. Common shared elements include the jack assembly 50 comprising a housing 502, supported by a base 501. There are a reservoir 505 and a handle receptacle 503 receiving a handle 510 for pressurizing the hydraulic fluid, or any other suitable medium, thus extending the ram or piston 506 to effect the lifting of the load. Additionally, a threaded saddle 507 is typically positioned within the conventional ram 506 to provide secure contact with the load.

Figure 2:
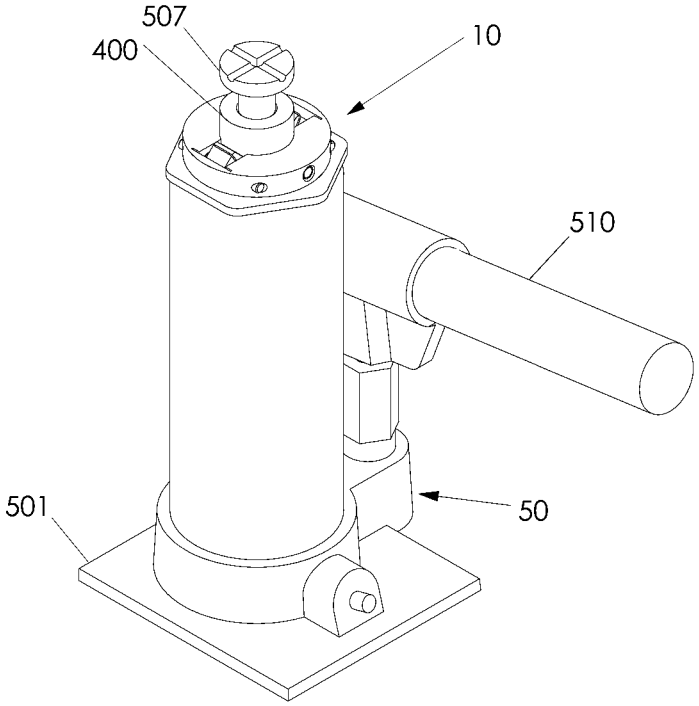
FIG. 2 is a perspective view of the disclosed device.
Figure 3:
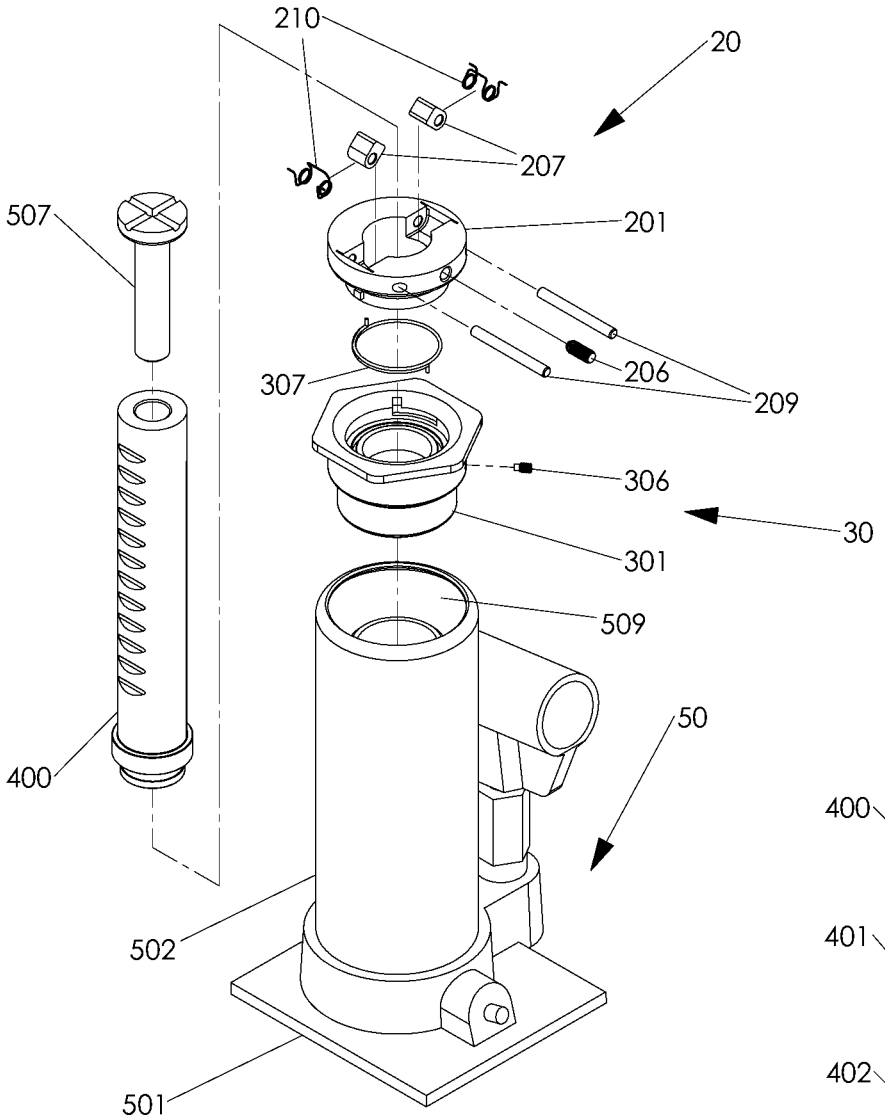
FIG. 3 is an exploded view of the device of FIG. 2 with all the elements of the disclosed device depicted.
Figure 3A:
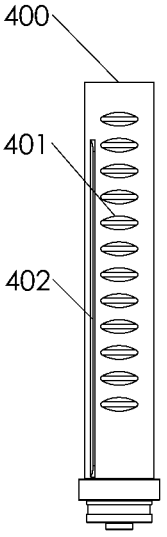
FIG. 3*a* is an isolated view of the ram showing rack teeth and a keyway slot.

The primary external distinguishing features between the conventional bottle jack and the disclosed lifting device are depicted in FIG. 2. Those features consist of the modified ram 400 and the ratchet mechanical assembly 10. The modified ram 400 is fully depicted in FIG. 3*a*. Readily apparent are the rack of teeth 401 positioned along the length of the ram and a keyway slot 402, offset from the rack of teeth, but also extending partway along the length of the ram. The ratchet mechanical assembly 10 comprises the upper 20 and lower 30 ring assemblies, depicted in their entirety in FIG. 3, an exploded view of the key elements of the disclosed device. Also depicted are the jack assembly 50 resting on its base 501 for stable placement or positioning of the device and its housing 502 for the containment of the ram 400. As mentioned supra, the ram is modified to include racked teeth 401 and a keyway slot 402.

When the gas or fluid medium within the reservoir 505 of the jack assembly 50 is pressurized, typically by the manual action of a handle 510 inserted into the handle receptacle 503 attached to the reservoir, the ram is urged to extend vertically through the apical opening 509 in the jack housing 502.

Figure 4:
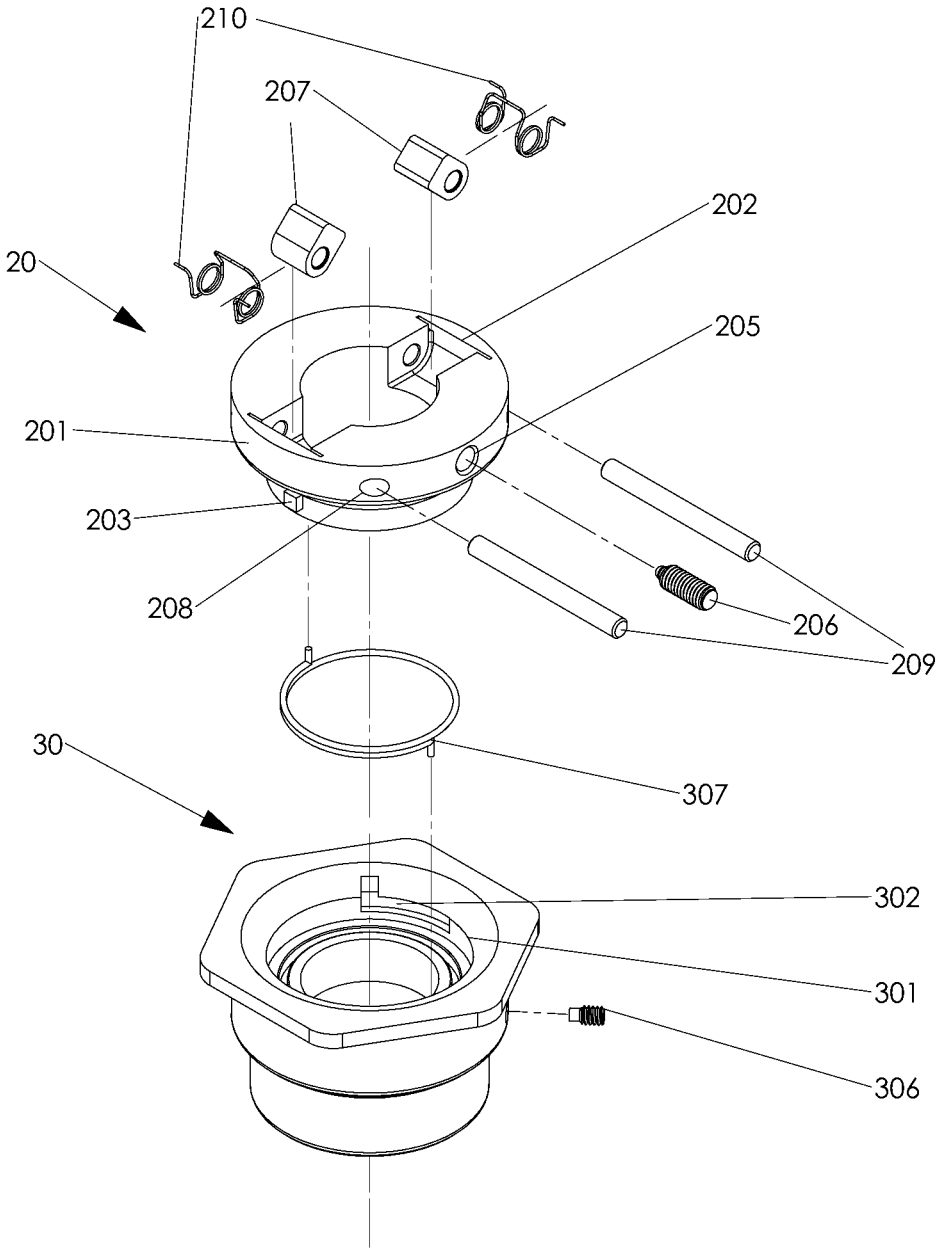
FIG. 4 is an exploded view of the upper and lower ring assemblies.
Figure 4A:
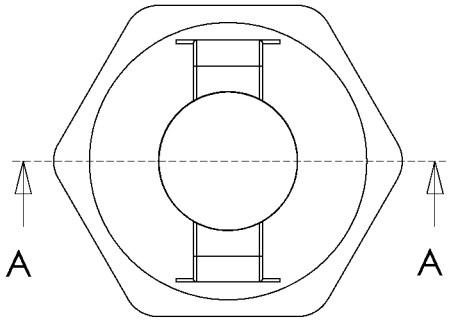
FIG. 4*a* is a top plan view of the assembled device showing the position of section line A-A.

Attached to the jack housing 502 at the apical opening 509 are the upper and lower ring assemblies 20 and 30. These assemblies are mated, preferably threaded, to allow and permit rotation between the two assemblies. The lower ring assembly 30 is attached directly to the apical opening 509 in the jack housing 502, preferably via mated threads. FIG. 4 provides an exploded view of the upper and lower ring assemblies 20 and 30. The lower ring assembly 30 comprises a lower ring body 301, annular in shape and having an inner opening suitably sized to accommodate the extended ram 400 to pass through its center, an internal, annular alignment slot 302 and a radially positioned set screw 306.

Also apparent in FIG. 4 are the elements of the upper ring assembly 20. The upper ring assembly comprises an upper ring body 201 annular in shape and having an inner opening suitably sized to accommodate the extended ram 400 to pass through its center, and attached, preferably by threaded means, to the top of the lower ring body 301. Positioned within the upper ring body 201 is a pawl socket 202 for the placement of a pawl 207 biased to make contact and engage with the rack teeth 401 on the ram 400 as it extends, when pressured, upwardly from the jack housing 502 through the mated upper and lower ring assemblies 20 and 30.

Figure 5:
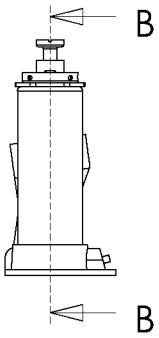
FIG. 5 is an elevated side view of the disclosed device showing the position of the plane section line B-B.
Figure 5A:
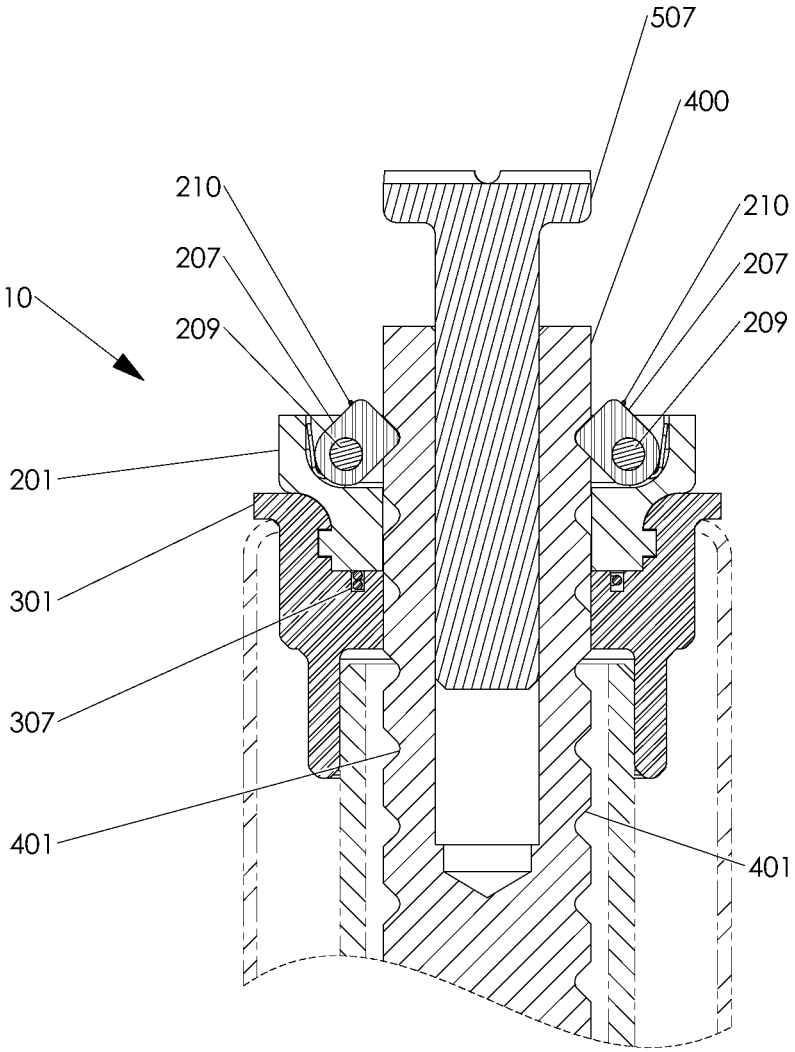
FIG. 5*a* is a partial, enlarged cross-sectional view of the disclosed device taken along line B-B of FIG. 5.
Figure 6:
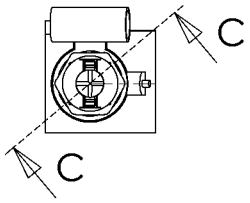
FIG. 6 is a top plan view of the disclosed device showing the plane of section line C-C.
Figure 6A:
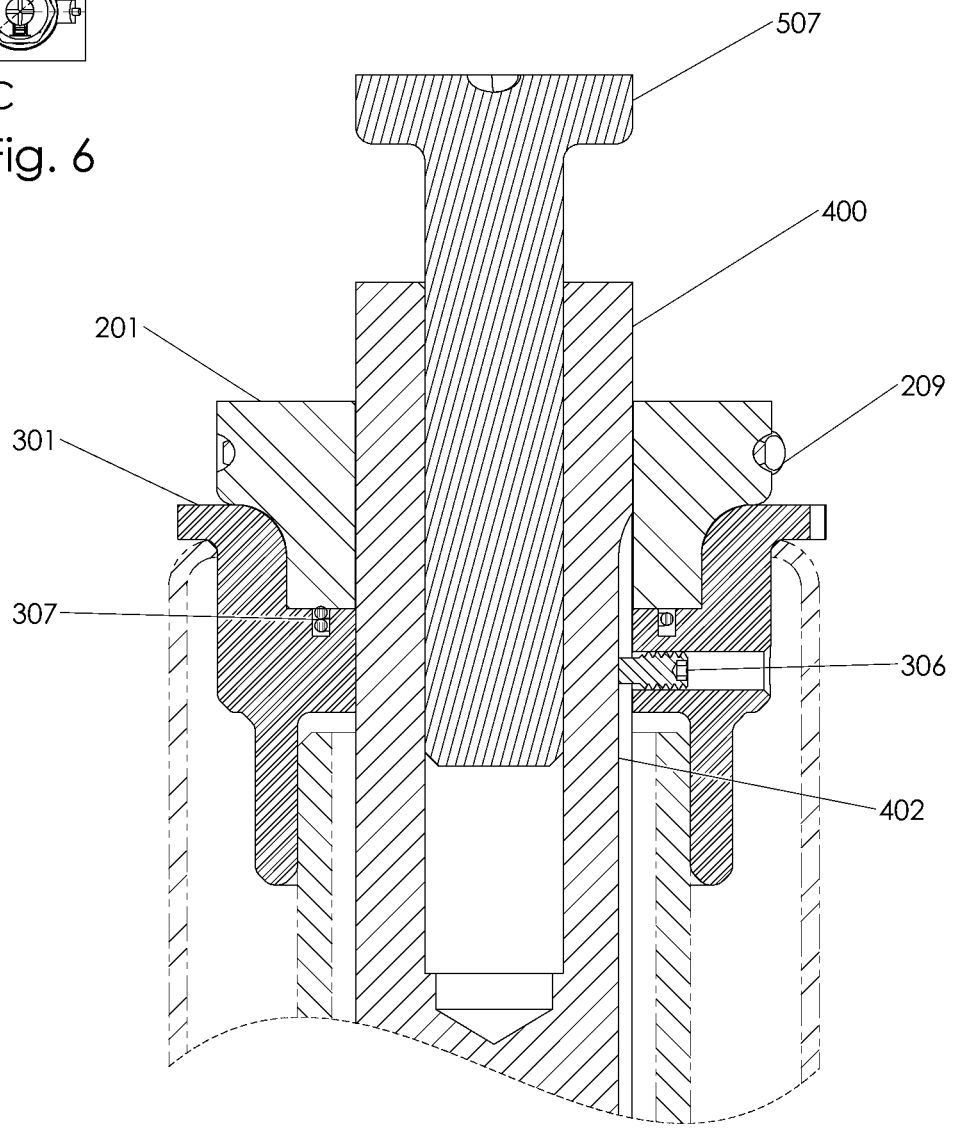
FIG. 6*a* is a partial, enlarged cross-sectional view of the disclosed device taken along line C-C of FIG. 6 showing the set screw disposed into the keyway slot.

The pawl 207, positioned in the pawl socket 202 within the upper ring body 20 and biased by a pawl torsion spring 210 to engage the rack teeth 401 on the ram 400, is allowed to rotate slightly away from the rack teeth to permit extension of the ram 400 by dint of its placement on pivot pin 209, which allows the pawl 207 to rotate within the pawl socket 202. The pivot pin extends chord-like through the upper ring assembly body 201 with the benefit of a pivot pin hole 208. At this juncture, it is helpful to note that while the pawl 207, the pawl socket 202, the pawl torsion spring 210 and the pawl pivot pin 209 are described in the singular, the preferred embodiment of the disclosed load support device 50 will feature the foregoing elements in pairs as depicted in FIGS. 4 and 5*a*.

Further apparent in FIG. 4, and an element of the upper ring assembly 20, is a spring plunger 206. The plunger is radially positioned in the upper ring body 201, extends through the spring plunger aperture 205, and is spring-biased to be compressed against the surface of the extended ram 400.

Situated externally on the body 201 of the upper ring assembly 20 is a pair of alignment flanges 203 (one depicted) to mate with the corresponding annular alignment slots 302 on the inner surface of the lower ring assembly 30. The proper mating of the alignment flanges within the alignment slots assures the proper range of rotation of the upper ring assembly 20 in relation to the lower ring assembly 30.

Figure 4B:
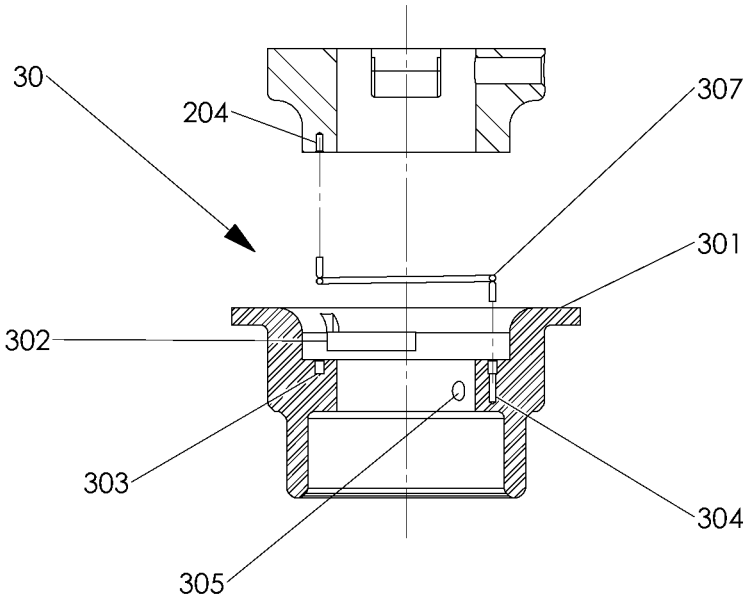
FIG. 4*b* shows an exploded, cross-sectional view of the upper and lower ring assemblies taken along line A-A of FIG. 4*a*.

Positioned between and attached to the upper and lower ring assemblies 20 and 30 is a mechanism torsion spring 307. One end of the torsion spring 307 is connected to the upper ring body 201 by disposition into torsion spring upper socket 204 (FIG. 4*b*) while the other end is disposed into torsion spring lower socket 304 of the lower ring body 301. The main body of spring 307 nests in torsion spring raceway 303 of the lower ring body 301.

In operation, the disclosed ratcheting load-support device has two positions: the "default" position wherein the ram 400 is able to be raised, (i.e., extended but not lowered) and the "secondary" position where lowering, (i.e., retracting the ram) is possible.

Figure 7A:
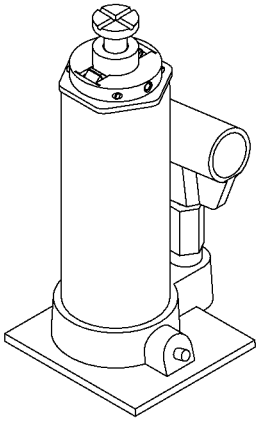
FIG. 7*a* is a perspective view of the disclosed device in the default position, as it would appear after the load has been lifted, with the ram retracted (lowered) and pawls engaged.
Figure 7B:
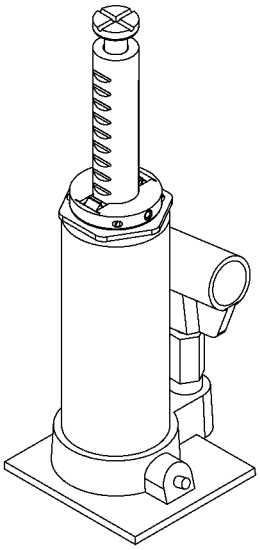
FIG. 7*b* is a perspective view of the disclosed device in the default position, as it would appear after the load has been lifted, with the ram extended (raised) and pawls engaged.

In a preferred embodiment and as depicted in FIGS. 5*a* and 7*a*, at the fully-retracted default position, ratchet pawls 207 are biased against ram 400 and engage with rack teeth 401 on the surface of the ram 400. As the operator pumps the jack handle 510, pressurizing the medium and causing the ram 400 to rise, pawl torsion springs 210 urge pawls 207 to maintain continuous contact against ram 400 but allow pawls 207 to pivot back and forth on pivot pins 209, while following the contour of the rack teeth 401. This back and forth, pivoting, rocking action results in a constant locking engagement between the ram and the pawls thus preventing ram 400 from descending in the event of a pressure failure. See FIG. 7*b* for a depiction of the disclosed device in raised ram default (locked) position.

Figure 7C:
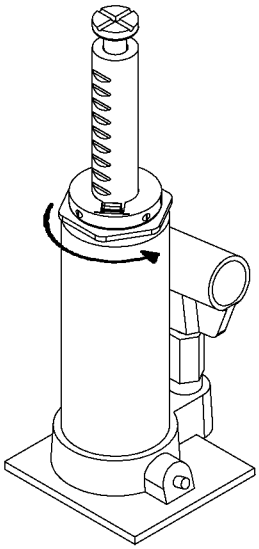
FIG. 7*c* is a perspective view of the disclosed device in the secondary position, as it would appear prior to lowering the load, with the ram extended (raised) and pawls released, after having spun the upper ring assembly in the direction indicated.

To lower the load, the operator must first release pawls 207 from their default locked position. To release the pawls 207, the operator (after raising the load slightly to take its weight off the mechanism) rotates upper ring body 201 in a counter-clockwise direction, moving the device to the secondary position and disengaging pawls 207 from the rack teeth 401. The turning of the upper ring body and disengagement of the pawls is depicted in FIG. 7*c*. Rotating upper ring body 201 in a counter-clockwise direction causes spring plunger 206 to encounter keyway slot 402 extending along the length of ram 400 allowing the spring plunger to extend into the keyway slot. Positioning spring plunger 206 in keyway slot 402 prevents upper ring body 201 from returning to its default position. While in this secondary position, the ram is disengaged from the rack teeth 401 and free to descend without interference and in a controlled manner as the operator directs.

Figure 7D:
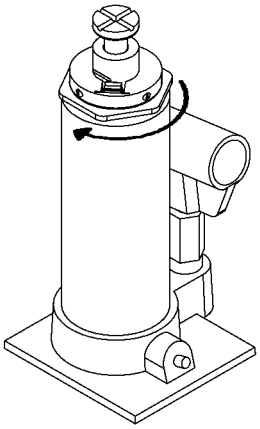
FIG. 7*d* is a perspective view of the disclosed device in the secondary position, as it would appear once the rack reaches full retraction, with the ram retracted (lowered) and the upper ring assembly poised to automatically rotate in the direction indicated.
Figure 8:
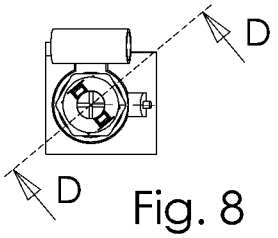
FIG. 8 is a top plan view of the disclosed device showing the plane of section line D-D.
Figure 8B:
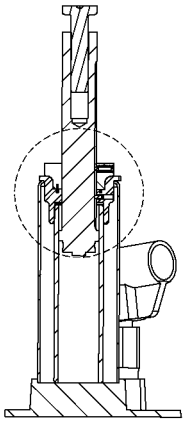
FIG. 8*b* is an elevated side view of the disclosed device in cross-section showing the isolated enlarged area depicted in FIG. 8*a*.
Figure 8A:
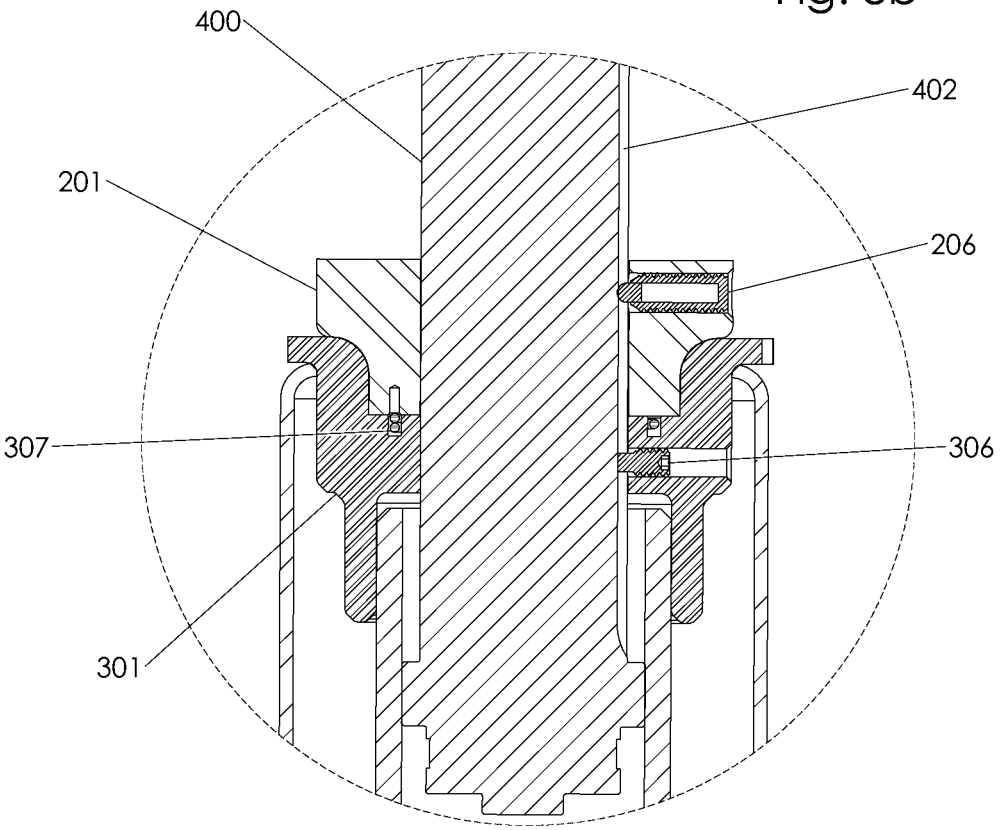
FIG. 8*a* is an isolated, enlarged cross-sectional view, taken along line D-D of FIG. 8, of the upper and lower ring assemblies in the secondary position shown in FIG. 7*c*.
Figure 9:
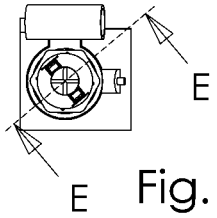
FIG. 9 is a top plan view of the disclosed device showing the plane of section line E-E.
Figure 9B:
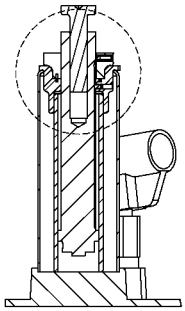
FIG. 9*b* is an elevated side view of the disclosed device in cross-section showing the isolated enlarged area depicted in FIG. 9*a*.
Figure 9A:
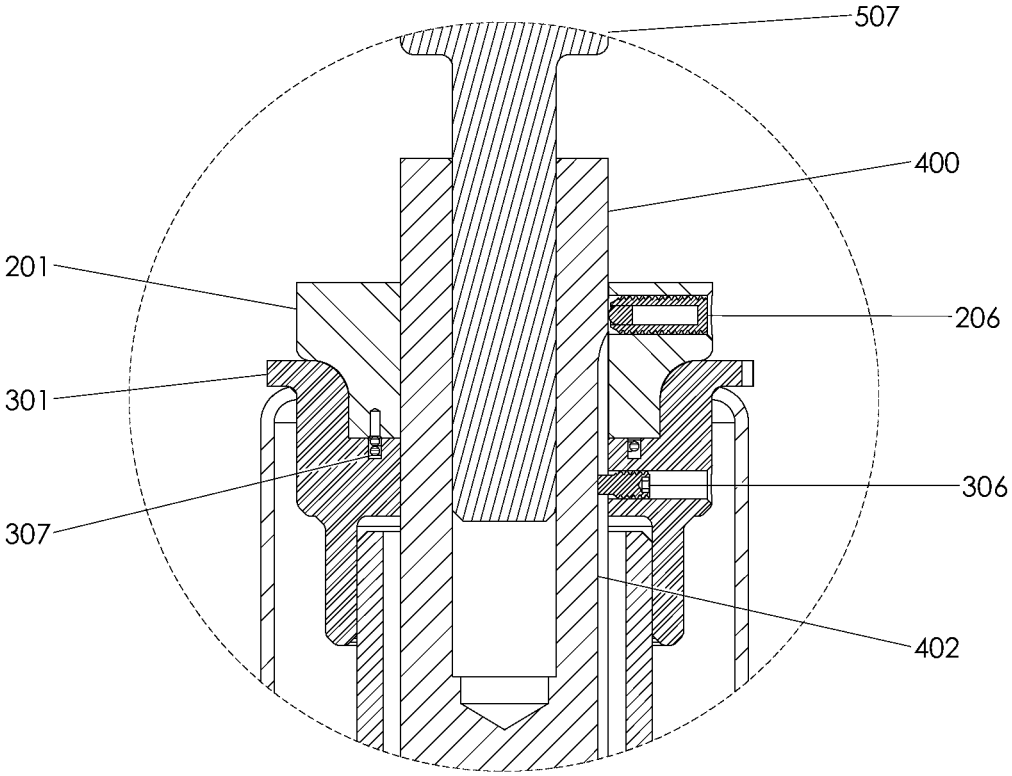
FIG. 9*a* is an isolated, enlarged cross-sectional view, taken along line E-E of FIG. 9, of the upper and lower ring assemblies in the secondary position shown in FIG. 7*d*.

As the ram 400 reaches the fully-lowered position (FIG. 7*d*), spring plunger 206 encounters the upper terminus of keyway slot 402 (FIG. 9). As the slot terminates, spring plunger 206 is compressed once more against the cylindrical surface of ram 400, thereby releasing upper ring body 201. The torque force maintained by mechanism torsion spring 307 then causes upper ring body 201 to rotate on its axis in a clockwise direction (FIG. 7*d*) returning pawls 207 to their default (engaged) position with the rack teeth 401. Thus, as ram 400 reaches its fully retracted position, ratchet mechanism 10 automatically resets to the default position shown in FIG. 7*a* and the device 50 is ready for the next use.

The ratcheting, self-aligning, load-lifting device 10 thus comprises a mechanism that functions simultaneously as a lifting jack and a safety stand. The locking mechanism integrated into the lifting capability of the jack eliminates the use of extraneous parts that can be lost, misplaced or misused. And, automatic engagement means that the operator need not take steps to engage the jack in order to benefit from its safety features.

The device herein described is one embodiment of the invention, intended as explanation rather than limitation. The disclosed mechanism is easily adaptable to jack designs of varying shapes, sizes and load capabilities. For example, the ratcheting, self-aligning load-support mechanism could be deployed on either pneumatic or hydraulic jacks, or the design could be modified to have the mechanism spin in either direction for release.

Additionally, the disclosed device could be manufactured from a variety of materials provided that they can be machined, fabricated or forged so as to perform the function required for the task at hand. Similarly, any and all pressure-receptive mediums could be used to move the ram, if suitable for the job requirements.

While the foregoing is a detailed and complete description of the preferred embodiment of the disclosed ratcheting, self-aligning load-lifting device, it should be apparent that numerous variations and modifications could be made to the disclosed device and utilized to implement the overall purpose of the device without deviating or departing from the spirit of the invention, which is fairly defined by the appended claims.

The invention claimed is:

1. A ratcheting, self-aligning, load-support device which comprises:

a housing having a base for stable placement of said device, said housing containing an elongated ram having a plurality of rack teeth along the length thereof and a keyway slot, offset from said rack teeth, and also extending a predetermined length along said ram, said housing having an apical opening for vertical extension of said ram;

a reservoir for containment of a medium in communication with said housing;

a means attached to said reservoir for pressurizing said medium;

upper and lower ring assemblies, mated to allow rotation between said assemblies, and wherein said lower ring assembly is attached to said housing at said apical opening;

at least one pawl positioned within said upper ring assembly biased to engage with said rack teeth;

a plunger radially positioned within said upper ring assembly for engagement with said keyway slot after said ring assemblies have been rotated to disengage said pawl from said rack teeth, thus permitting lowering of said ram;

a set screw radially positioned within said lower ring assembly for continuous engagement with said keyway slot to maintain alignment of said teeth on said ram with said pawl on said upper ring assembly; and, a biasing means attached to and positioned between said upper and lower ring assemblies biased to urge said upper ring assembly to rotate when said ram has been fully lowered, thereby re-engaging said pawl with said rack teeth.

2. The load-support device according to claim 1 wherein there are a pair of pawls diametrically positioned within said upper ring assembly.

3. The load-support device according to claim 2 wherein said ram has a pair of rack teeth diametrically positioned along the length thereof.

4. The load-support device according to claim 1 wherein said lower ring assembly is threadably attached to said apical opening of said housing.

5. The load-support device according to claim 1 wherein said set screw also maintains alignment of said lower ring assembly with said rack of teeth.

6. The load-support device according to claim 1 wherein said medium is hydraulic fluid.

7. The load-support device according to claim 1 wherein said medium is air.

* * * * *